US010127756B2

(12) United States Patent
Kim

(10) Patent No.: US 10,127,756 B2
(45) Date of Patent: Nov. 13, 2018

(54) MEDIUM PROCESSING APPARATUS AND FINANCIAL DEVICE

(71) Applicant: ATEC AP CO., LTD., Seongnam-si, Gyeonggi-do (KR)

(72) Inventor: Hyun Kim, Seoul (KR)

(73) Assignee: ATEC AP CO., LTD., Seongnam-si, Gyeonggi-do (KR)

( * ) Notice: Subject to any disclaimer, the term of this patent is extended or adjusted under 35 U.S.C. 154(b) by 0 days.

(21) Appl. No.: 14/754,055

(22) Filed: Jun. 29, 2015

(65) Prior Publication Data

US 2015/0379799 A1 Dec. 31, 2015

(30) Foreign Application Priority Data

Jun. 30, 2014 (KR) ..... 10-2014-0081271

(51) Int. Cl.

| | |
|---|---|
| ***G07F 7/04*** | (2006.01) |
| ***G07D 11/00*** | (2006.01) |
| ***E05B 65/46*** | (2017.01) |
| ***G07F 19/00*** | (2006.01) |

(52) U.S. Cl.

CPC ..... *G07D 11/0006* (2013.01); *E05B 65/46* (2013.01); *E05B 65/461* (2013.01); *G07D 11/00* (2013.01); *G07F 19/20* (2013.01)

(58) Field of Classification Search

CPC .... E05B 2065/469; E05B 65/44; E05B 65/46; E05B 65/461; E05B 65/462; E05B 65/463; E05B 65/464; E05B 65/465; E05B 65/466; E05B 65/467; E05B 65/468; G07D 11/0006; G07D 11/00; G07D 11/0021;

(Continued)

(56) References Cited

U.S. PATENT DOCUMENTS 3,764,171 A * 10/1973 Anderson ..... E05B 65/46 100/229 A
3,990,630 A * 11/1976 Cutter ..... E05G 5/006 232/43.3

(Continued)

FOREIGN PATENT DOCUMENTS

CN 102194288 A 9/2011
KR 20060073675 A 6/2006

(Continued)

OTHER PUBLICATIONS

English Translation of WO2010143352A1 (Year: 2010).*

(Continued)

*Primary Examiner* — Jeffrey A Shapiro

(74) *Attorney, Agent, or Firm* — Saliwanchik, Lloyd & Eisenschenk

(57) ABSTRACT

A medium processing apparatus is provided. The medium processing apparatus comprises a first cassette support to at least one first cassette, a second cassette support to support at least one second cassette, the second cassette support being connected to the first cassette support, a container in which the first and second cassette supports are received, and a first locking unit to lock the second cassette support and the first cassette support. When the first locking unit is released, the second cassette support is pulled out to the outside of the container in a state in which the first cassette support is disposed in the container.

8 Claims, 13 Drawing Sheets

(58) Field of Classification Search
CPC ..... G07D 11/0084; G07D 11/0087; G07D 13/00; G07D 2207/00; G07D 2211/00
USPC ..... 70/84–88; 194/206, 207; 209/534; 235/379; 109/47; 49/4
See application file for complete search history.

(56) References Cited

U.S. PATENT DOCUMENTS 5,062,598 A * 11/1991 Winkler ..... G07D 11/0018 221/21
6,250,475 B1 * 6/2001 Kwasniewicz ..... B03C 1/284 209/223.1
6,375,235 B1 * 4/2002 Mehmen ..... E05B 65/46 292/128
7,850,164 B2 12/2010 Ahn et al.
2005/0017607 A1 * 1/2005 Weinberger ..... A47B 67/04 312/215
2010/0188190 A1 * 7/2010 Pukari ..... E05B 47/063 340/5.6
2010/0308704 A1 * 12/2010 Rahilly ..... E05B 65/462 312/319.5
2011/0221426 A1 9/2011 Han
2012/0133260 A1 * 5/2012 Johnson ..... E05B 65/46 312/333
2012/0261874 A1 * 10/2012 Arikata ..... G07D 11/0081 271/9.01
2013/0256332 A1 * 10/2013 Fumanelli ..... G07F 19/203 221/12
2014/0069768 A1 * 3/2014 Yokote ..... G07D 11/0003 194/200
2014/0217669 A1 * 8/2014 Aoji ..... B65H 31/22 271/297
2014/0339974 A1 * 11/2014 Gill ..... A47B 88/04 312/333

FOREIGN PATENT DOCUMENTS

KR 20080064581 A * 7/2008 ..... F25D 25/00
KR 20100060969 A 6/2010
KR 101072163 B1 10/2011
KR 20130078475 A 7/2013
KR 1020130078477 A 7/2013
WO WO2010143352 A1 * 12/2010 ..... A47B 88/467

OTHER PUBLICATIONS

English Translation of KR 20080064581 A (Year: 2008).*
Office Action dated May 2, 2017 in Chinese Application No. 201510385851.7.
European Search Report dated Sep. 11, 2015 in European Application No. 15174228.5.
Notice of Allowance dated Dec. 15, 2015 in Korean Application No. 119980968000.

* cited by examiner

MEDIUM PROCESSING APPARATUS AND FINANCIAL DEVICE

CROSS-REFERENCE TO RELATED APPLICATION

This application claims the benefit under 35 U.S.C. § 119 of Korean Patent Application No. 10-2014-0081271, filed Jun. 30, 2014, which is hereby incorporated by reference in its entirety.

BACKGROUND

Technical Field

The present disclosure relates to a medium processing apparatus and a financial device.

Related Art

In general, financial devices are devices that process a financial transaction desired by a customer. The financial devices may deposit or withdraw a medium or automatically transfer the medium.

There is an "Unlock apparatus for medium cassette box" disclosed in Korea Patent Registration No. 1072163 (Registration Date: Oct. 4, 2011), which is a prior document.

The unlock apparatus for medium cassette box comprises a medium cassette box slidably pulled out from a main body and a plurality of medium cassettes and reject box, which are separably mounted on the medium cassette box.

However, according to the prior document, in order to pull out the reject box out of the main body, the medium cassette box on which the plurality of medium cassettes and the reject box are mounted has to be slidably pulled out. In this case, since the user has to slide the medium cassette box by using power which is greater than the sum of weights of the plurality of medium cassettes, weight of the reject box, and weight of the medium cassette box, user's work convenience may be deteriorated. Also, when the medium cassette box is pulled out to separate the reject box, a portion of the plurality of medium cassettes is exposed to the outside, and thus security may be deteriorated.

BRIEF SUMMARY

Embodiments provide a medium processing apparatus and a financial device in which only a portion of a plurality of cassettes is pulled out to improve workability and increase security.

In one embodiment, a medium processing apparatus comprises: a first cassette support to support at least one first cassette; a second cassette support to support at least one second cassette, the second cassette support being connected to the first cassette support; a container in which the first and second cassette supports are received; and a first locking unit to locking the second cassette support and the first cassette support, wherein, when the first locking unit is released, the second cassette support is pulled out to the outside of the container in a state in which the first cassette support is disposed in the container.

In another embodiment, a financial device comprises: a container; a first cassette support received in the container and on which at least one first cassette is mounted; a second cassette support received in the container and on which at least one second cassette is mounted; and a first locking unit to maintain a state in which the second cassette support is connected to the first cassette support, wherein, when the first locking unit is released, the second cassette support is pulled out to an outside of the container in a state in which the first cassette support is disposed in the container.

When a state in which the second cassette support is connected to the first cassette support is maintained by the first locking unit, the first and second cassette supports may be pulled out from the container.

The financial device may further comprise a second locking unit for maintaining a state in which the first cassette support is disposed in the container while the second cassette support is pulled out from the container.

The financial device may further comprise a first locking release unit for releasing the first locking unit; and a second locking release unit for releasing the second locking unit, wherein a portion of each of the locking release unit is disposed on a front surface of the second cassette support.

The financial device may further comprise a rail for independently pulling out the second cassette support from the container.

The details of one or more embodiments are set forth in the accompanying drawings and the description below. Other features will be apparent from the description and drawings, and from the claims.

BRIEF DESCRIPTION OF THE DRAWINGS

FIG. 10 is a view illustrating a state in which each of a first locking unit and a second locking unit is in a locked state according to the second embodiment.

FIG. 11 is a view illustrating a state in which the first locking unit is released according to the second embodiment.

FIG. 12 is a view illustrating a state in which a second cassette is pulled out to the outside of the container according to the second embodiment.

FIG. 13 is a view illustrating a state in which the second locking unit is released according to the second embodiment.

DETAILED DESCRIPTION

Figure 1:
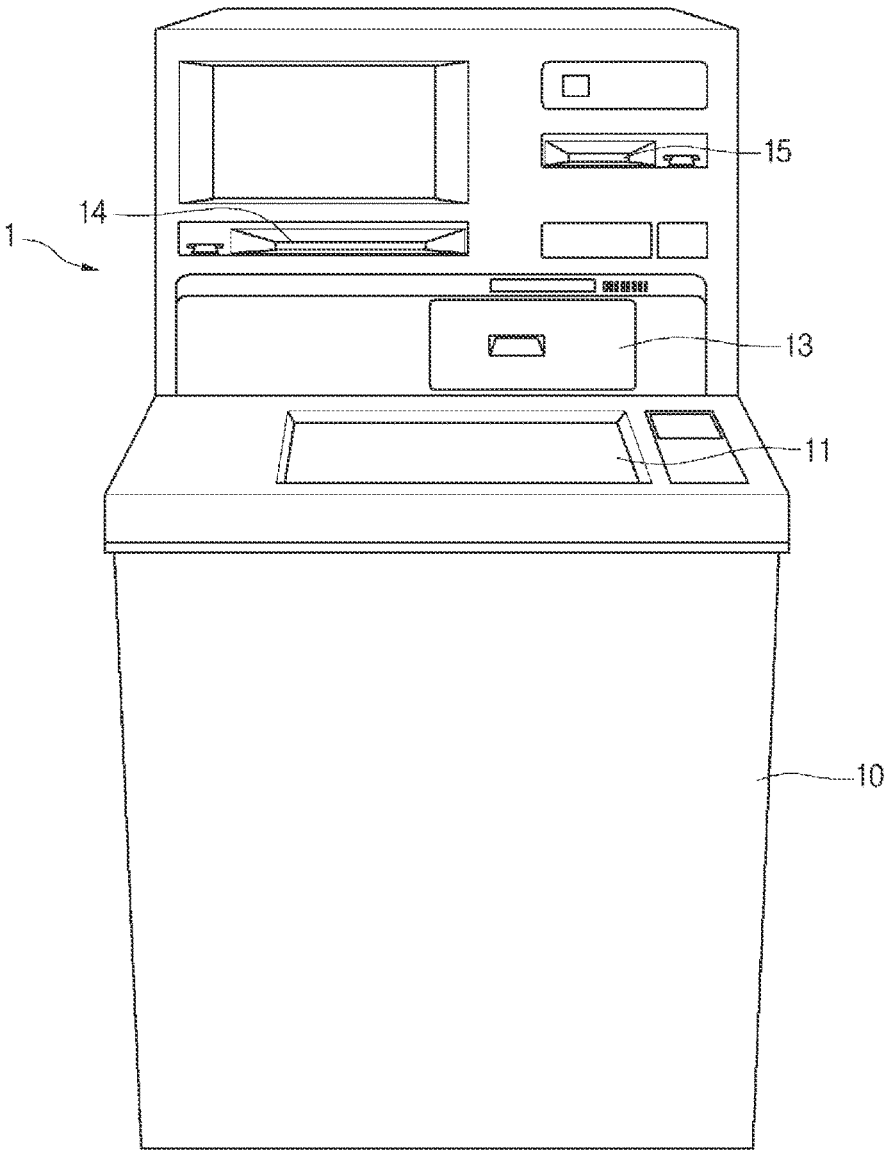
FIG. 1 is a perspective view of a financial device according to a first embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing including processing such as deposit processing, giro receipt, or gift certificate exchange and/or processing such as withdrawal processing, giro dispensing, or gift certificate dispensing by receiving various media such as, e.g., paper moneys, checks, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Figure 2:
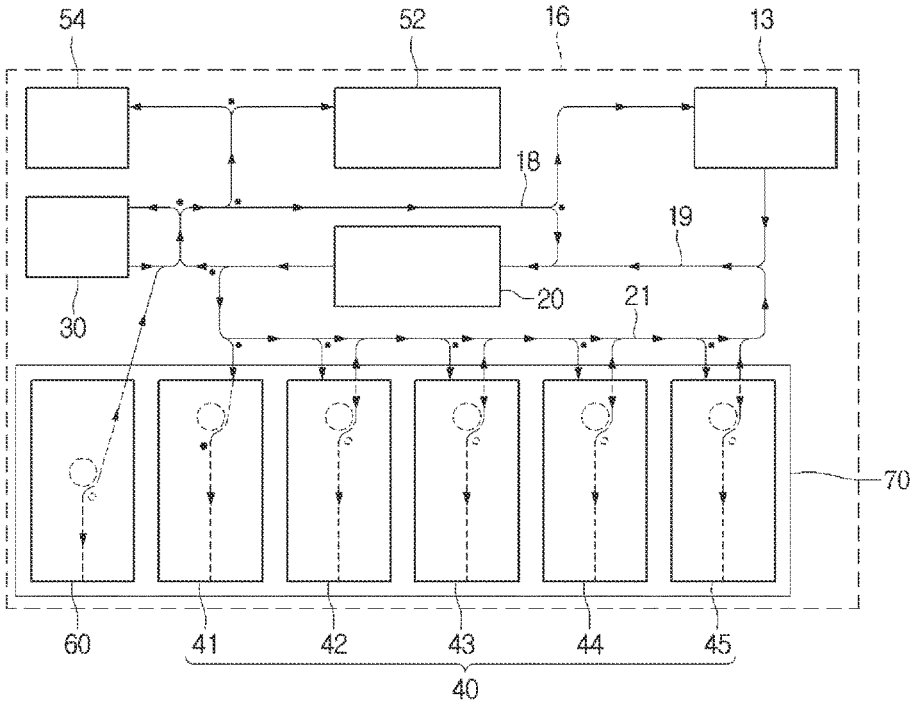
FIG. 2 is a view of a medium processing apparatus according to the first embodiment.

FIG. 1 is a perspective view of a financial device according to a first embodiment, and FIG. 2 is a view of a medium processing apparatus according to the first embodiment.

Referring to FIGS. 1 and 2, a financial device 1 according to the current embodiment may comprise a main body 10 in which a plurality of components are built. The main body 10 may comprise a medium accepting and dispensing part 13 for depositing or withdrawing a medium.

The medium accepting and dispensing part 13 comprises a medium handling space that is accessible by a customer. The medium handling space may be opened or closed by a blocking member such as a shutter or a cover. Alternatively, the medium handling space may be maintained in an opened state without being closed.

The medium accepting and dispensing part 13 may act as a common accepting and dispensing part through which various kinds of media are accepted or dispensed. The media may be accepted into the medium accepting and dispensing part 13 in a bundle unit comprising a sheet. Also, the media may be dispensed from the medium accepting and dispensing part in the bundle unit.

Also, according to the kind of financial device 1, the financial device 1 may further comprise a bankbook entrance part 14 for accepting or dispensing a bankbook and a card entrance part 15 for accepting or dispensing a card. In the current embodiment, the bankbook entrance part 14 or the card entrance part 15 may be called a customer information acquisition part for acquiring information of a customer. The current embodiment is not limited to the kind of customer information acquisition part. For example, the customer information acquisition part may acquire information recorded in an RFID tag or USB or acquire customer's information by using customer's biometric information such as a fingerprint.

Also, the financial device 1 may further comprise a user interface 11 displaying a menu or information for depositing or withdrawing the medium and inputting or selecting a command or information for depositing or withdrawing the medium.

The financial device 1 may further comprise a medium processing apparatus 16.

The medium processing apparatus 16 may comprise the medium accepting and dispensing part 13.

The medium processing apparatus 16 may further comprise a discrimination part 20. The discrimination part 20 may distinguish the kind of medium or determine faulty medium when the medium is accepted or dispensed.

The medium processing apparatus 16 may further comprise a temporary stacker 30 in which the medium is temporarily stacked. The temporary stacker 30 may temporarily store the medium accepted through the medium accepting and dispensing part 13 when the customer intends to deposit the medium into the financial device 10. The medium stacked in the temporary stacker 30 may be transferred into a medium storage box 40 that will be described later when medium acceptance is finally decided by the customer. Or, the temporary stacker 30 may temporarily stack the medium to be transferred to the medium accepting and dispensing part.

The medium processing apparatus 16 may further comprise the medium storage box 40 for storing the medium. The medium storage box 40 may comprise one or more medium cassettes 41 to 45. For example, the medium storage box 40 comprising a plurality of medium cassettes is illustrated in FIG. 2.

The one or more medium cassettes 41 to 45 may comprise at least one bill cassette and at least one check cassette. In the present disclosure, the numbers of the bill cassette and check cassette are not limited thereto. For example, the medium storage box 40 may comprise only at least one bill cassette or only at least one check cassette.

The medium processing apparatus 16 may further comprise a first reject box 52 in which a medium determined as a faulty medium while the medium is deposited is stored, a second reject box 54 in which a medium determined as a faulty medium while the medium is withdrawn is stored, and an operational cassette 60 for supplementing or recovering the medium. The operational cassette 60 may store the medium to be supplemented into the medium storage box 40. The operational cassette 60 may use as a reject box or a medium storage box to store deposited media or media for withdrawing.

In the present disclosure, respective modules (the medium accepting and dispensing part, the discrimination part, the medium storage box, the temporary stacker, and the reject box) constituting the financial device 10 may be connected to each other by a plurality of transfer paths 18, 19, and 20.

To improve security of the financial device, the medium storage box 40 and the operational cassette 60 may be received in a container 70 having a door on which a locking unit is disposed. For example, the container 70 may be a safe.

Figure 3:
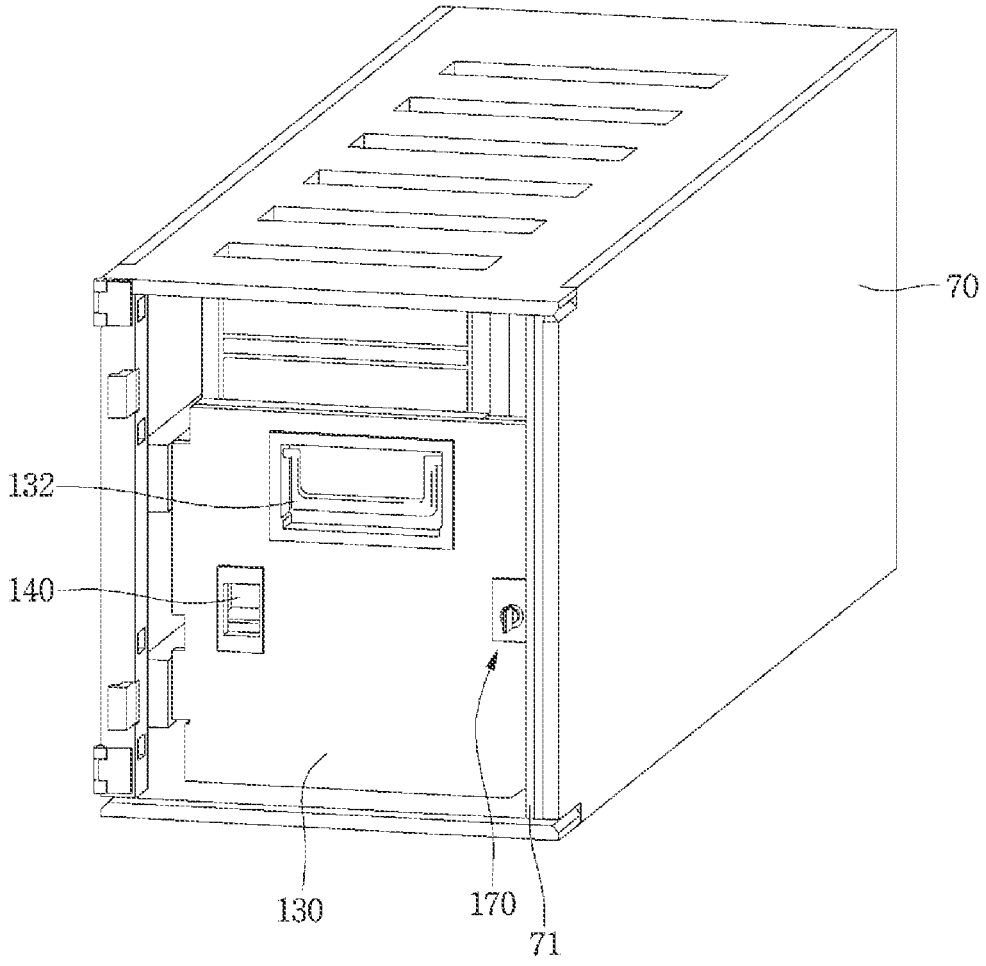
FIG. 3 is a vies illustrating a state in which a first cassette and a second cassette are received in a container according to the first embodiment.
Figure 4:
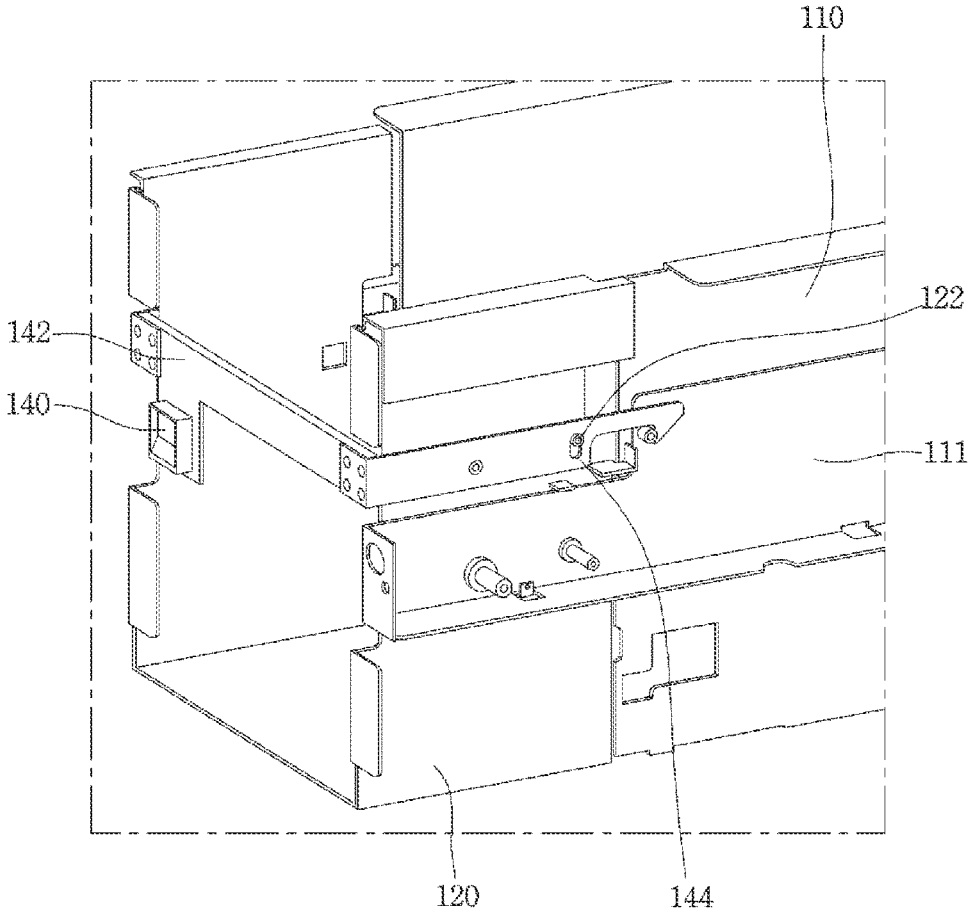
FIGS. 4 and 5 are views illustrating a process in which a first locking unit is released to separate the second cassette.
Figure 5:
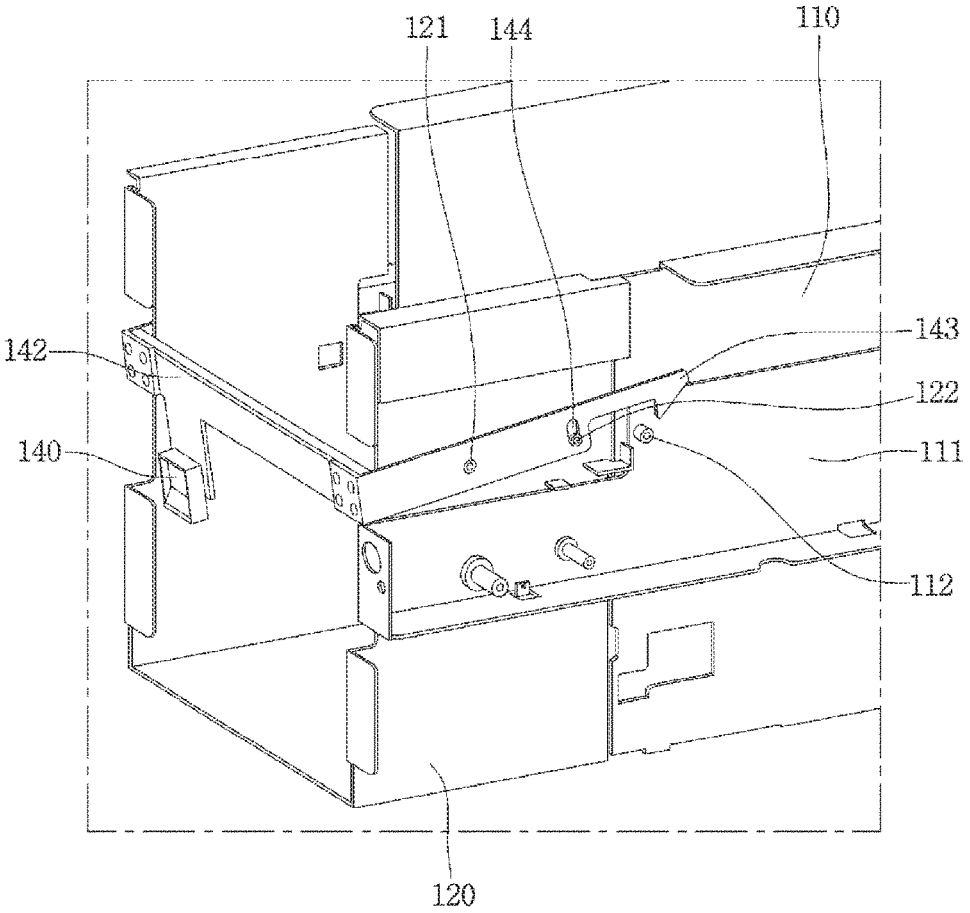
Figure 6:
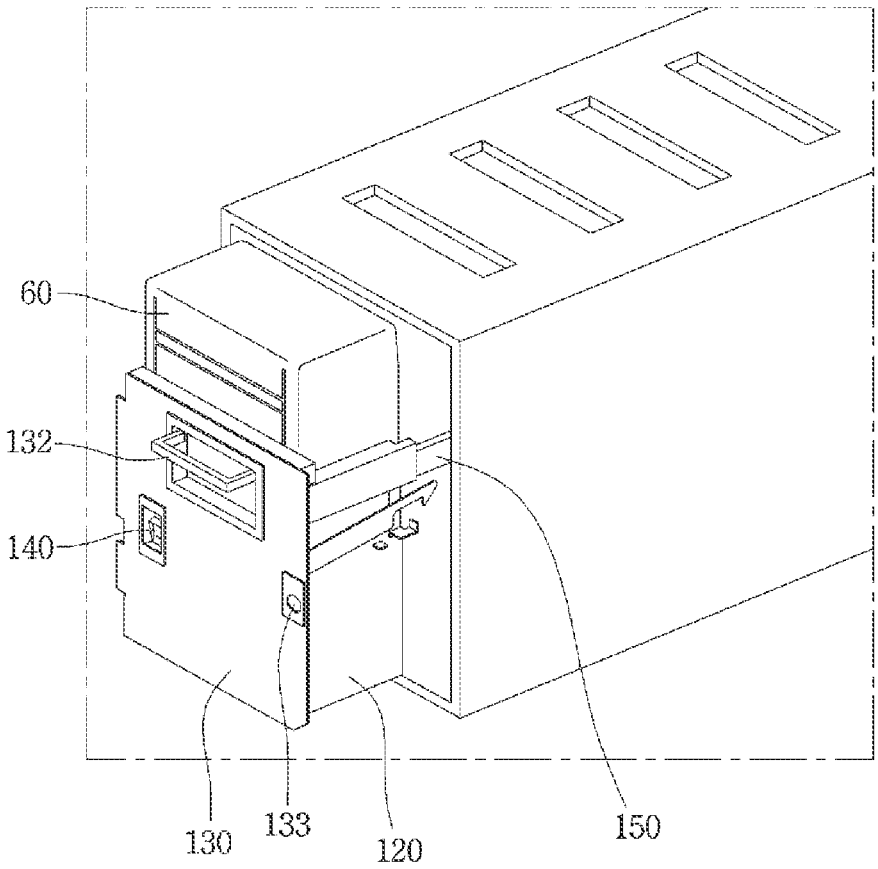
FIG. 6 is a view illustrating a state in which the second cassette is pulled out from container.

FIG. 3 is a view illustrating a state in which a first cassette and a second cassette are received in a container according to the first embodiment, and FIGS. 4 and 5 are views illustrating a process in which a first locking unit is released to separate the second cassette, and FIG. 6 is a view illustrating a state in which the second cassette is pulled out from the container.

In the present embodiment, the operational cassette may be called the second cassette and the plurality of medium cassettes may be called a first cassette.

FIGS. 4 and 5 illustrate a state in which a second locking unit and a safety unit that will be described later are removed.

Referring to FIGS. 3 and 6, a first cassette support 110 on which the one or more medium cassettes 41 to 45 are separably mounted and a second cassette support 120 on which the operational cassette 60 is mounted, which is relatively movably connected to the first cassette support 110, are received in the container 70. The one or more medium cassettes 41 to 45 may be separably mounted or fixedly mounted on the first cassette support 110.

The container 70 may comprise an opening 71 through which each of the cassette supports 110 and 120 is inserted and pulled out. The opening 71 may be opened and closed by a door that is not illustrated. Of course, a locking unit that is not illustrated may be disposed on the door and released by a key of a manager who has authority to access to the container 70.

In the container 70, the second cassette support 120 is disposed adjacent to the opening 71. Thus, the second cassette support 120 may be firstly pulled out to the outside from the container 70.

The second cassette support 120 may be independently pulled out from the container 70 with respect to the first cassette support 110. The second cassette support 120 may be connected to the first cassette support 110 by a first rail 150. Thus, the second cassette support 120 may relatively move with respect to the first cassette support 110 by the first rail 150.

The second cassette support 120 may comprise a front panel 130 for covering the operational cassette 60 mounted on the second cassette support 120. When the door of the container 70 is opened, the front panel 130 may be exposed to the outside of the operational 70.

A handle 132 may be disposed on the front panel 130.

The first cassette support 110 may be coupled to or released from the second cassette support 120 by a first locking unit. When the first and second cassette supports 110 and 120 are received in the operational 70, the two cassette supports 110 and 120 may be coupled to each other by the first locking unit. Also, when the two cassette supports 110 and 120 are released from each other, only the second cassette support 120 may be pulled out from the operational 70 by the first rail 150.

The first locking unit may comprise a first locking pin 112 on a bracket 111 disposed on a side surface of the first cassette support 110 and a first locking lever 142 rotatably connected to the second cassette support 120. Here, the first locking pin 112 may be directly disposed on the first cassette support 110.

The first locking unit may be released by a release lever 140. The release lever 140 is connected to the first locking lever 142. The release lever 140 may be exposed to the outside of the second cassette support 120.

The bracket 111 may be coupled to the side surface of the first cassette support 110 or integrated with the first cassette support 110. Thus, hereinafter, the present disclosure will be described in a state in which the bracket 111 is omitted.

The release lever 140 may be disposed on the front panel 130. The first locking lever 142 may comprise a hook 143 catching on the first locking pin 112.

The first locking lever 142 may be rotatably connected to a rotation shaft 121 disposed on the second cassette support 120.

In the current embodiment, when the hook 143 of the first locking lever 142 is caught on the first locking pin 112, the second cassette support 120 is coupled to the first cassette support 110. Also, when the hook 143 of the first locking lever 142 is released from the first locking pin 112, the second cassette support 120 is released from the first cassette support 110.

A guide pin 122 is disposed on the second cassette support 120. Also, a guide slot 144 to which the guide pin 122 is inserted may be defined in the first locking lever 142 to limit a rotation range of the first locking lever 142. The guide slot 144 may have an arc shape so that the guide pin 122 is rotatable in a state where the guide pin 122 is inserted into the guide slot 144. Thus, the first locking lever 142 may rotate within a range of the guide slot 144.

Referring to FIGS. 5 and 6, when the release lever 140 is not manipulated in a state where the operational cassette 60 is received in the container 70, the first locking lever 142 is maintained in a state where the first locking lever 142 is caught on the first locking pin 112.

To pull out only the operational cassette 60 from the container 70, the user may manipulate the release lever 140. The first locking lever 142 may rotate in a counterclockwise direction by manipulation of the release lever 140 and thus be released from the first locking pin 112. Then, the coupling between the first cassette support 110 and the second cassette support 120 is released, and thus the second cassette support 120 is in a state in which the second cassette support 120 can be pulled out to the outside of the container 70.

Then, when the user pulls the handle 132, the second cassette support 120 on which the operational cassette 60 is mounted is slidably pulled out from the container 70 by the first rail 150 in a state in which the first cassette support 110 is disposed in the container 70.

Of course, the first cassette support 110 is maintained in a state where the first cassette support 110 is fixed to the container 70 by the second locking unit that will be described later.

Thus, according to the current embodiment, since the second cassette support on which the operational cassette is mounted is connected to the first cassette support on which the plurality of medium cassettes are mounted by the first locking unit, when it is intended to pull out only the operational cassette, the coupling between the two cassette supports by the first locking unit may be released, and thus, only the second cassette support may be pulled out to the outside of the container.

Thus, since the user pulls out the second cassette support by using power that is greater than the sum of the weight of the operational cassette and the weight of the second cassette support, the user does not need to pull out entire medium cassettes mounted on the first cassette support, and thus the user may pull out the operational cassette by relatively small power.

Also, when the operational cassette is pulled out from the container, since the one or more medium cassettes is received in the container, an outside may not access to the one or more medium cassettes, and thus security may be improved.

Figure 7:
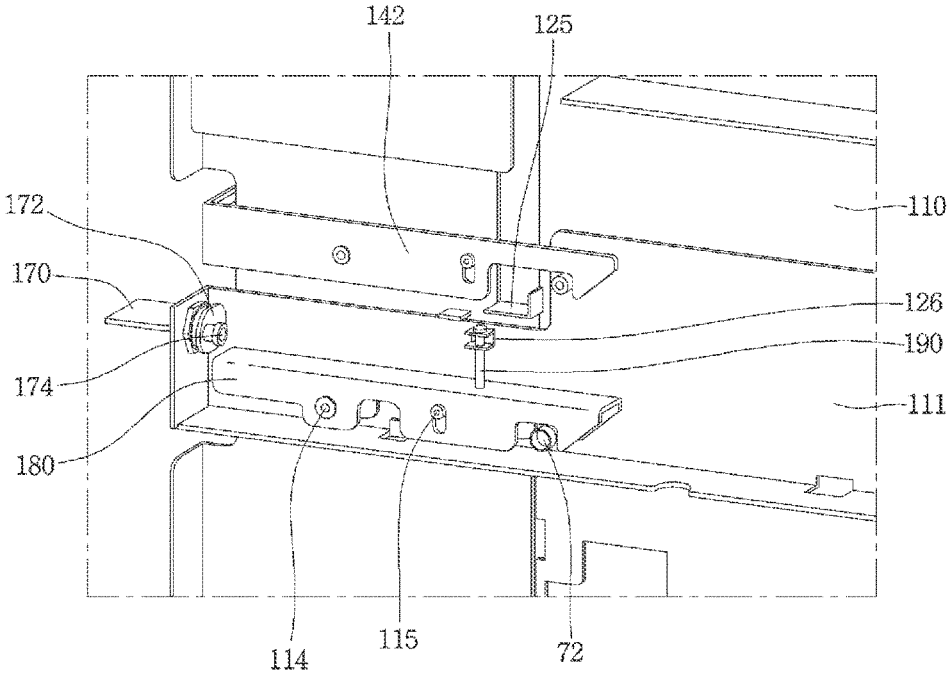
FIGS. 7 and 8 are views illustrating a process in which a second locking unit is released to separate the first cassette.
Figure 8:
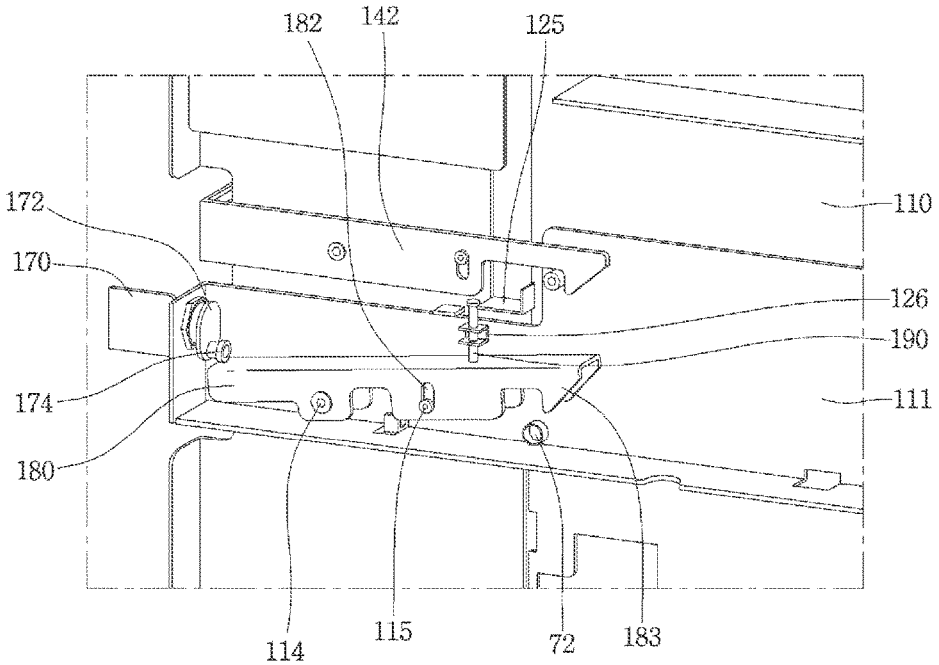
Figure 9:
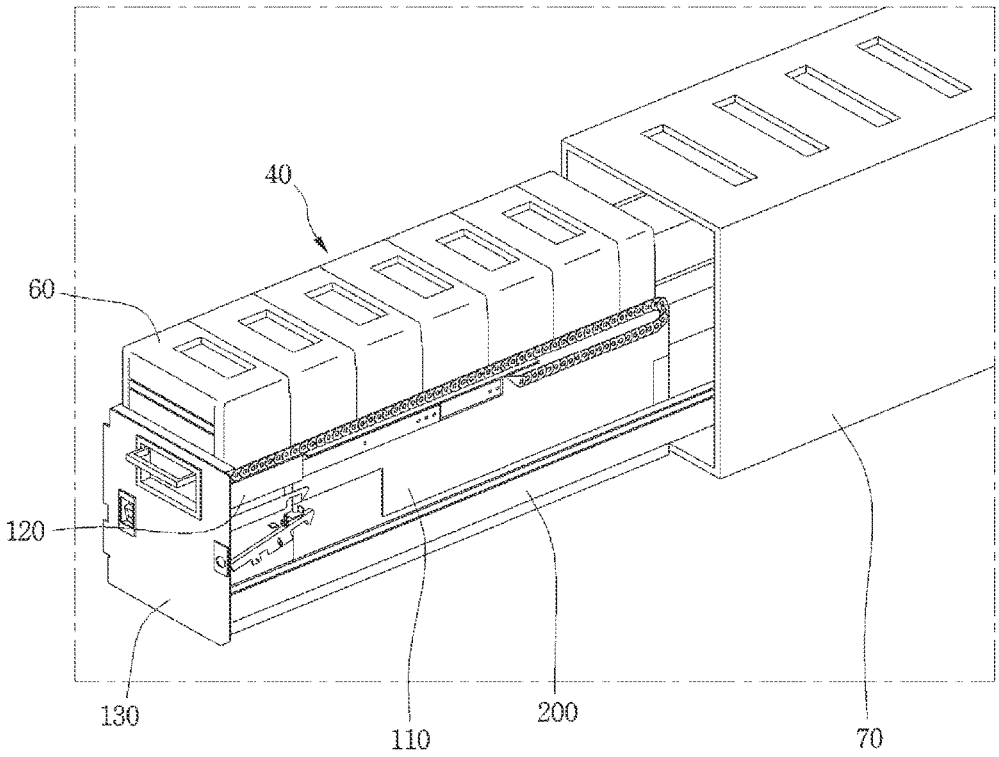
FIG. 9 is a view illustrating a state in which the first cassette and the second cassette are pulled out from the container.

FIGS. 7 and 8 are views illustrating a process in which a second locking unit is released to separate the first cassette, and FIG. 9 is a view illustrating a state in which the first cassette and the second cassette are pulled out from the container.

Referring to FIGS. 7 and 8, the second locking unit according to the current embodiment may comprise a second locking pin 72 disposed on the container 70 and a second locking lever 180 rotatably disposed on the first cassette support 110 to catch on the second locking pin 72.

A rotation shaft 114 for rotating the second locking lever 180 is disposed on the first cassette support 110. Also, a guide pin 115 is disposed on the first cassette support 110. Also, a guide slot 182 into which the guide pin 115 is inserted to limit a rotation range of the second locking lever 180 may be defined in the second locking lever 180.

The guide slot 182 may have an arc shape so that the guide pin is rotatable in a state where the guide pin 115 is inserted into the guide slot 182. Titus, the second locking lever 180 may rotate in the range of the guide slot 182.

The second locking unit may be released by a locking release unit 172. The locking release unit 172 may be disposed on the first cassette support 110 and coupled to a key 170 for releasing the locking to transmit a manipulation force of the key 170 to the second locking lever 180.

The locking release unit 172 may comprise a roller 174 or a contact part formed of a rubber material to prevent the locking release unit 172 itself and the second locking lever 180 from being damaged while the locking release unit 172 transmits the manipulation force of the key 170 to the second locking lever 180.

A hole 133 through which the key 170 passes may be defined in the front panel 130 of the second cassette support 120.

In a state in which the second locking unit is released by the locking release unit 172, a state where the first locking lever 142 is coupled to the first locking pin 143 may be maintained. Thus, when the user pulls the handle 132 in the state in which the locking of the second locking unit is released, the first cassette support 110 may be pulled out to the outside of the container 70 together with the second cassette support 120.

Here, if the first locking lever 142 is unstably coupled to the first locking pin 143, when the handle 132 is pulled in the state in which the locking of the second locking unit is released, the first locking lever 142 is released from the first locking pin 143, and thus only the second cassette support 120 may be pulled out from the container 70. In this case, since the key 170 is coupled to the locking release unit 172 disposed on the first cassette support 110, if the key 170 was held by the user, only the second cassette support 120 is pulled out to the outside of the container 70 in the state where the key 170 is coupled to the locking release unit 172 of the first cassette support 110. Thus, during this process, a user's hand may be caught in the hole 133 defined in the second cassette support 120 and thus be injured. On the other hand, if the first locking lever 142 is stably coupled to the first locking pin 143, when the handle 132 is pulled, the first cassette support 110 to which the key 170 is coupled is pulled out together with the second cassette support 120, and thus the user's hand may be secure from injury.

Thus, in the current embodiment, a phenomenon in which only the second cassette support 120 is pulled out from the container in the state in which the locking of the second locking unit is released may be prevented by the safety unit.

The safety unit may comprise a safety pin 190 moving by the second locking lever 180 when the second locking lever 180 rotates to release the locking of the second locking lever 180 and the second locking pin 72, a pin support part 126 disposed on the first cassette support 110 to guide movement of the safety pin 190, and a hook rib 125 disposed on the second cassette support 120 and caught by the safety pin 190.

In the state in which the locking of the second locking unit is released, the safety pin 190 is disposed on a moving path of the hook rib 125 while the second and first cassette supports 120 and 110 are pulled out together to prevent a phenomenon in which only the second cassette support 120 is pulled out from the container 70. On the other hand, when the second locking lever 180 is caught on the second locking pin 72, the safety pin 190 deviates from the moving path of the hook rib 125.

Thus, according to the current embodiment, even if the second lever 142 is unstably coupled to the first locking pin 112, since the safety pin 190 is disposed on the moving path of the hook rib 125 while the locking of the second locking unit is released, when the handle 132 is pulled to pull out the second and first cassette supports 120 and 110, the hook rib 125 may be caught by the safety pin 190, and thus the first cassette support 110 may be pulled out to the outside of the container 70 together with the second cassette support 120.

The first cassette support 110 may be connected to the container 70 by a second rail 200. Thus, the second and first cassette supports 120 and 110 may be slidably pulled out from the container box 70 by the second rail 200.

Figure 10:
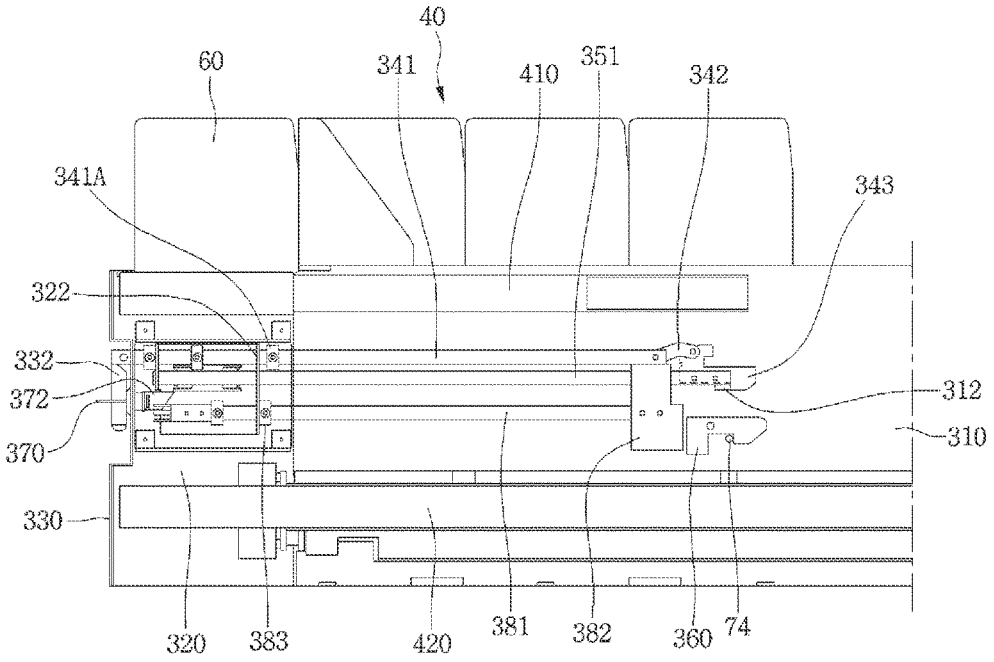
FIGS. 10 to 13 are views illustrating a pulling structure of a cassette in a financial device according to a second embodiment.
Figure 11:
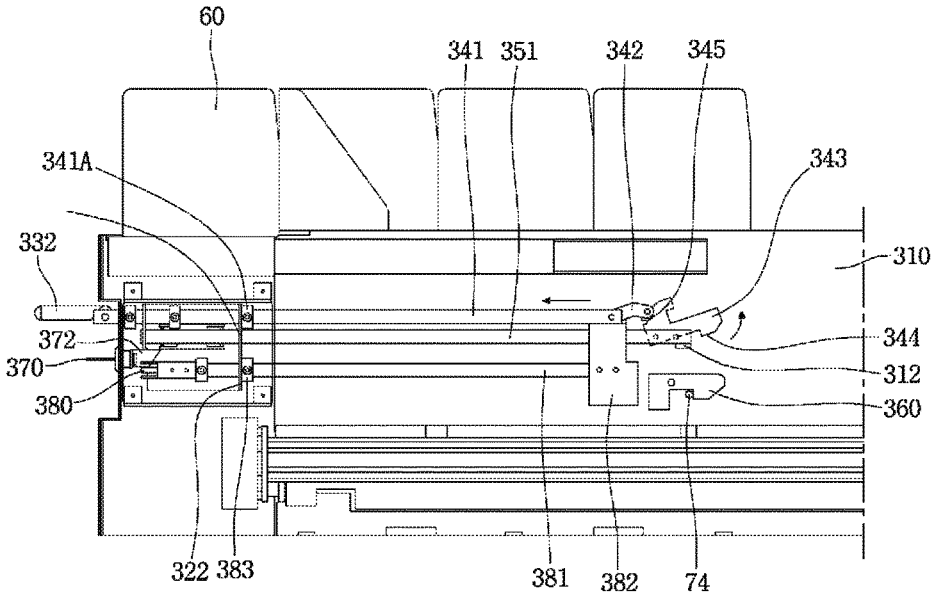
Figure 12:
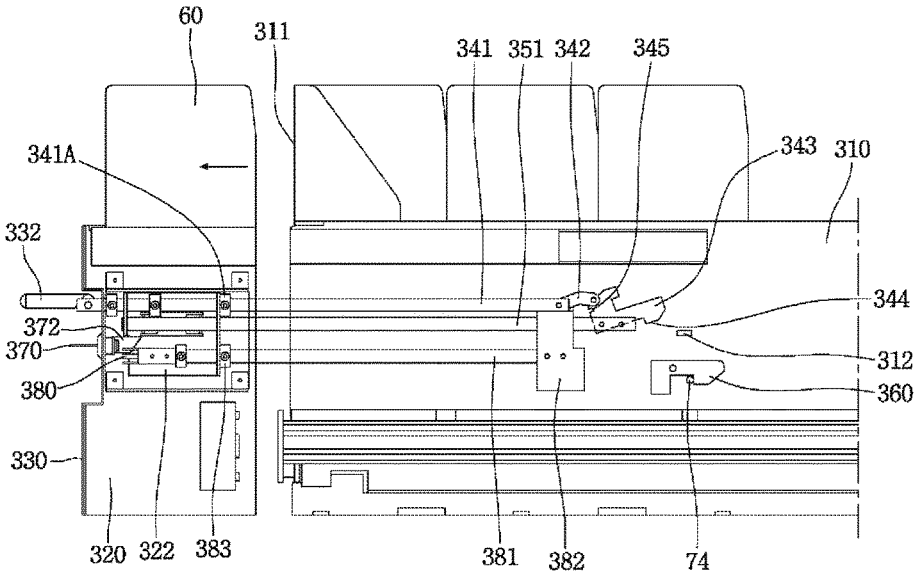
Figure 13:
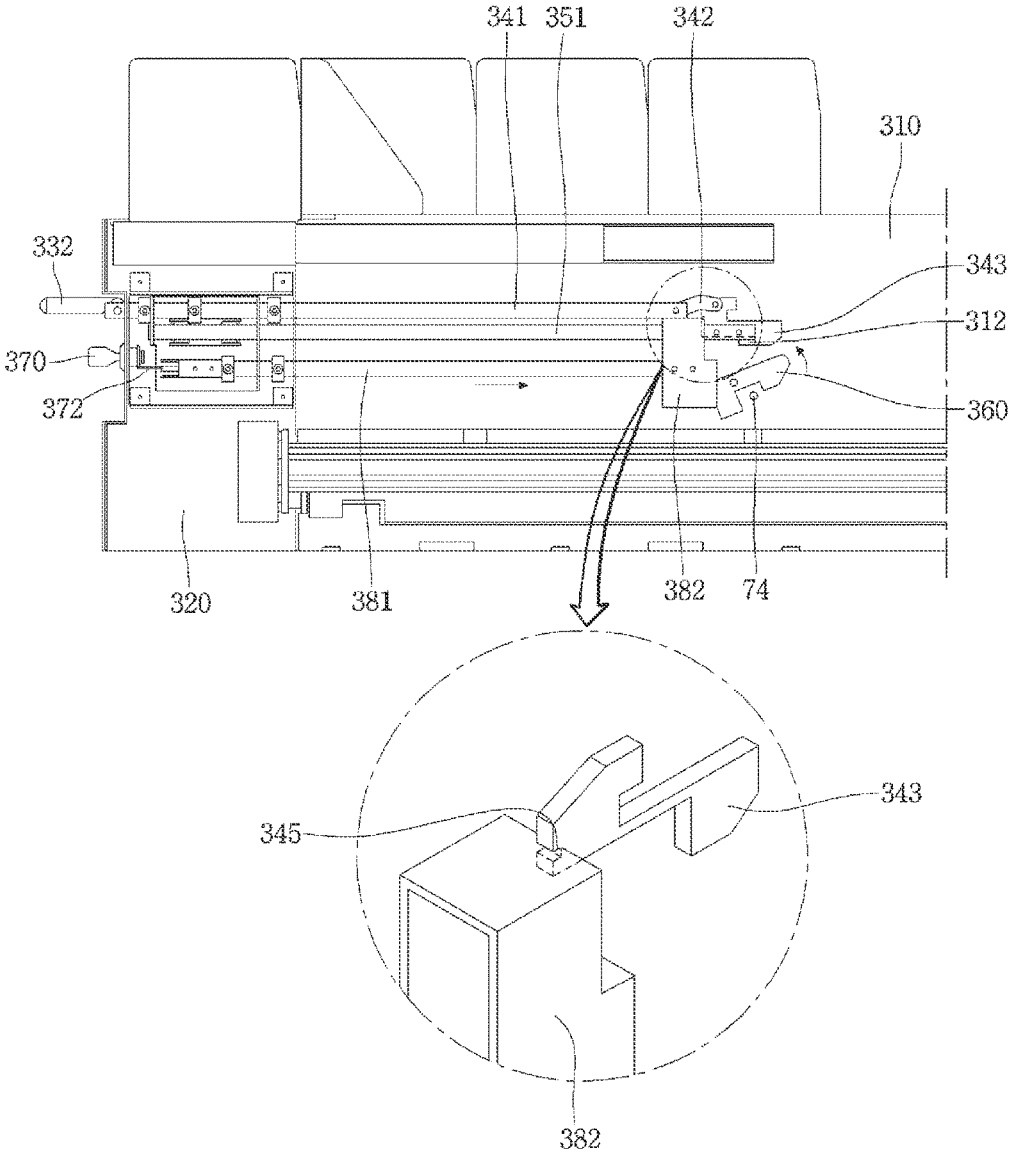

FIGS. 10 to 13 are views illustrating a pulling structure of a cassette in a financial device according to a second embodiment. FIG. 10 is a view illustrating a state in which each of a first locking unit and a second locking unit is in a locked state according to the second embodiment, and FIG. 11 is a view illustrating a state in which the first locking unit is released according to the second embodiment, and FIG. 12 is a view illustrating a s which a second cassette is pulled out to the outside of the container according to the second embodiment, and FIG. 13 is a view illustrating a state in which the second locking unit is released according to the second embodiment.

In the present embodiment, the operational cassette may be called the second cassette and the plurality of medium cassettes may be called a first cassette.

FIGS. 10 to 13 illustrate a state in which the container is removed to clearly understand a structure of the financial device.

First, referring to FIG. 10, in the container according to the current embodiment, a first cassette support 310 on which one or more medium cassettes 41 to 45 are separably mounted and a second cassette support 320 relatively movably connected to the first cassette support 310 and on which the operational cassette 60 is mounted may be received.

The second cassette support 320 may be connected to the first cassette support 310 by a first rail 410. The first cassette support 310 may be connected to the container by a second rail 420.

A state in which the second cassette support 320 is coupled to the first cassette support 310 may be maintained by a first locking unit, and a state in which the first cassette support 310 is coupled to the container may be maintained by a second locking unit.

The first locking unit may comprise a first locking pin 312 disposed on the first cassette support 310 and a first locking lever 343 caught on the first locking pin 312. Locking of the first locking unit may be released by a first locking release unit.

The first locking release unit may comprise a release lever 332 and a plurality of transmission members 341 and 342 for transmitting a manipulation force of the release lever 332 to the first locking unit. Also, the first locking lever 343 may by rotatably supported by a support bar 351.

The plurality of transmission members 341 and 342 may comprise a first transmission member 341 rotatably connected to the release lever 332 and a second transmission member 342 rotatably connected to the first transmission member 341 and the first locking lever 343. The release lever 332 may be a handle that is disposed on an outer portion of a front panel 330 of the second cassette support 320.

A guide bracket 322 for allowing the first transmission member 341 to horizontally move is disposed on the second cassette support 320. Also, a stopper 341A caught on the guide bracket 322 when the first transmission member 341 moves in a direction where the locking of the first locking unit is released is disposed on the first transmission member 341 in a state in which the first locking unit is locked, the stopper 341A is spaced apart from the guide bracket 322.

The support bar 351 is disposed in parallel with the first transmission member 341 and fixed to the second cassette support 320.

Also, an elastic member (not shown) for providing an elastic force to the first locking lever 343 so that the first locking lever 343 rotates in a direction where the first locking lever 343 is caught on the first locking pin 312 may be disposed on a rotation shaft of the first locking lever 343.

Referring to FIGS. 10 and 11, when the release lever 332 is not manipulated in a state in which the operational cassette 60 is received in the container, the first locking lever 343 is maintained in a state in which the first locking lever 343 is caught on the first locking pin 312.

To pull out only the operational cassette 60 from the container 70, the user may manipulate the release lever 332. That is, the user may pull the release lever 332. Then, the first and second transmission members 341 and 342 which are connected to the release lever 332 may move toward the release lever 332 (a left direction on the drawings). Here, the first locking lever 343 may rotate in a counterclockwise direction by movement of the second transmission member 342 to release the locking of the first locking unit. That is, the first locking lever 343 is released from the first locking pin 312.

Here, while the release lever 332 is pulled to move the first transmission member 341 to a left side, the second cassette support 320 is maintained in a stopped state before the stopper 341A contacts the guide bracket 322.

In a state in which the locking of the first locking unit is released, the user may continuously pull the release lever 332. Then, while the first transmission member 341 moves to the left side, the stopper 341A contacts the guide bracket 322. Here, in a state in which the stopper 341A contacts the guide bracket 322, as illustrated in FIG. 12, a force pulling the release lever 332 may be transmitted to the second cassette support 320 through e guide bracket 322. Thus, in a state in which the first cassette support 310 is disposed in the container, only the second cassette support 320 may be pulled out to the outside of the container by the first rail 410.

A block cover 311 for blocking outside exposure of the medium cassette mounted on the first cassette support 310 is disposed on a front surface (a surface facing the second cassette support) of the first cassette support 310.

Thus, since the outside exposure of the medium cassettes 41 to 45 is blocked by the block cover 311 in the state in which the second cassette support 320 is pulled out to the outside of the container by the first rail 410, access to the medium cassettes by the outsider may be effectively prevented.

According to the current embodiment, since the release lever for releasing the first locking unit acts as a handle, if the release lever is pulled in a state in which the user holds the release lever, the operational cassette is pulled out, and thus, the user's working convenience may be improved.

The second locking unit may comprise a second locking pin 74 disposed on the container and a second locking lever 360 rotatably disposed on the first cassette support 310 to catch on the second locking pin 74.

An elastic member (not shown) for providing an elastic force to the second locking lever 360 so that the second locking lever 360 rotates in a direction in which the second locking lever 360 is caught on the second locking pin 74 may be disposed on a rotation shaft of the second locking lever 360.

The locking of the second locking unit may be released by a second locking release unit.

The locking release unit may comprise a third and fourth transmission members 372 and 381 for transmitting a manipulation force of a key 370 for releasing the locking to the second locking lever 360. The third transmission member 372 may be coupled to the key 370 to rotate by the key 370. The fourth transmission member 381 may be horizontally movably disposed on the second cassette support 320 to rotate the second locking lever 360.

The fourth transmission member 381 may comprise a roller 380 or a contact part formed of a rubber material to prevent the third and fourth transmission members 372 and 381 from being damaged while the third transmission member 372 transmits the manipulation force of the key 370 to the second locking lever 360.

Also, the horizontal movement of the fourth transmission member 381 may be guided by the guide bracket 322. A stopper 383 for restricting the fourth transmission member 381 from moving in the left side in the state in which the second locking unit is locked is disposed on the fourth transmission member 381. The stopper 383 may contact the guide bracket 322. Referring to FIG. 10, in the state in which the second locking unit is locked, the stopper 383 may contact the guide bracket 322.

A safety bracket 382 contacting the second locking lever 360 and selectively coupled to the first locking lever 343 may be connected to the fourth transmission member 381. The safety bracket 382 may act as a safety unit for preventing the second cassette support 320 from being pulled out to the outside of the container in the state in which the second locking unit is released. That is, the safety bracket 382 may prevent the first locking unit from being released in the state in which the locking of the second locking unit is released.

An insertion portion 345 into which a portion of the safety bracket 382 is inserted while the locking of the second locking unit is released may be defined in the first locking lever 343.

Hereinafter, a locking release process of the second locking unit will be described.

Referring to FIG. 13, to pull out the plurality of medium cassettes 41 to 45 together with the operational cassette 60 to the outside of the container, the user connects the key 370 to the second locking release unit to rotate the key 370 at a predetermined angle. Then, the third transmission member 372 rotates, and the fourth transmission member 381 moves to a right side of the drawing by the rotation of the third transmission member 372. Then, the safety bracket 382 connected to the fourth transmission member 381 rotates the second locking lever 360 in the counterclockwise direction, and thus the locking of the second locking unit is released. That is, the second locking lever 360 is released from the second locking pin 74. Also, the safety bracket 382 is inserted into the insertion portion 345 of the first locking lever 343.

In this state, if the user pulls the release lever 332, the first locking lever 343 is interrupted by the safety bracket 382 inserted into the insertion portion 345 and thus is not rotatable, and thus the first locking lever 343 may be maintained in a state in which the first locking lever 343 is caught on the first locking pin 312. Thus, a force pulling the release lever 332 may be transmitted to the first cassette support 310 by the first locking pin 312 to allow the first cassette support 310 to be pulled out together with the second cassette support 320 as illustrated in FIG. 9.

In the current embodiment, since constitutions of the first locking unit and constitutions of the second locking unit are disposed on a position that is defined inward from the opening of the container, the outsider may not easily access to the first and second locking units, and thus security may be improved.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium processing apparatus comprising:

a first cassette support to support at least one first cassette;

a second cassette support to support at least one second cassette, the second cassette support being connected to the first cassette support at a front side of the first cassette support;

a container in which the first and second cassette supports are received;

a first locking unit to lock the second cassette support and the first cassette support;

a second locking unit to lock the first cassette support and the container;

a first locking release unit to release the locking of the first locking unit; and a second locking release unit to release the locking of the second locking unit, wherein the first locking unit comprises:

a first locking pin disposed on the first cassette support; and a first locking lever connected to the second cassette support to be coupled with the first locking pin, wherein the first locking release unit comprises:

a release lever exposed to an outside of the second cassette support; and a plurality of transmission members to transmit a manipulation force of the release lever to the first locking lever, including a first transmission member connected to the release lever and a second transmission member connected to the first transmission member and the first locking lever, wherein the second locking unit comprises:

a second locking pin disposed on the container; and a second locking lever connected to the first cassette support to catch on the second locking pin, wherein the second locking release unit comprises:

a third transmission member rotated by a key to release the locking of the second locking unit; and a fourth transmission member to transmit the manipulation force of the key to the second locking lever, wherein, when the first locking unit is released, the second cassette support and the at least one second cassette are independently pulled out of the container in the first direction with respect to the first cassette support in a state in which the first cassette support and the at least one first cassette are disposed in the container, and wherein when the second cassette support is independently pulled out from the container, the second cassette support is spaced apart from the first cassette support.

2. The medium processing apparatus of claim 1, further comprising:

a first rail to pull the second cassette support out of the container; and a second rail to pull the first cassette support out of the container, the second rail being spaced apart from the first rail in a vertical direction.

3. The medium processing apparatus of claim 2, wherein the first rail connects the first cassette support to the second cassette support.

4. The medium processing apparatus of claim 1, wherein the release lever is a handle.

5. The medium processing apparatus of claim 1, further comprising a guide bracket disposed on the second cassette support to guide a horizontal movement of the first transmission member, and a stopper disposed on the first transmission member to allow the manipulation force of the release lever to be transmitted to the guide bracket.

6. The medium processing apparatus of claim 1, further comprising a support bar connected to the first cassette support to rotatably support the first locking lever.

7. The medium processing apparatus of claim 1, wherein a safety bracket to prevent the first locking unit from being released in a state in which the second locking unit is released is connected to the fourth transmission member, and an insertion portion into which the safety bracket is inserted while the second locking unit is released is defined in the first locking lever.

8. The medium processing apparatus of claim 1, further comprising a block cover disposed on the first cassette support to block an exposure of the first cassette mounted on the first cassette support in a state in which the second cassette support is pulled out of the container.

* * * * *